US007341437B2

(12) United States Patent
Hwang et al.

(10) Patent No.: US 7,341,437 B2
(45) Date of Patent: Mar. 11, 2008

(54) CAPACITY-CHANGING UNIT OF ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 11/208,655

(22) Filed: Aug. 23, 2005

(65) Prior Publication Data

US 2006/0127257 A1 Jun. 15, 2006

(30) Foreign Application Priority Data

Dec. 14, 2004 (KR) ..... 10-2004-0105662

(51) Int. Cl.
*F01C 20/18* (2006.01)

(52) U.S. Cl. ..... 418/29

(58) Field of Classification Search ..... 417/212, 417/213, 283, 285; 418/55.1–55.6, 57, 58, 418/59, 64, 270
See application file for complete search history.

(56) References Cited

U.S. PATENT DOCUMENTS 3,125,031 A * 3/1964 Rydberg ..... 418/59
3,125,032 A * 3/1964 Smith ..... 418/59
3,195,470 A * 7/1965 Smith ..... 418/56
3,463,091 A * 8/1969 Delsuc ..... 418/59
3,645,653 A * 2/1972 Arnold ..... 418/56
4,235,572 A * 11/1980 Winkler et al. ..... 418/6
5,011,386 A * 4/1991 Guttinger ..... 418/59
5,024,114 A * 6/1991 Guttinger ..... 74/86
5,051,070 A * 9/1991 Kazaoka et al. ..... 417/295
5,383,773 A * 1/1995 Richardson, Jr. ..... 418/57
6,746,223 B2 * 6/2004 Manole ..... 418/55.1

OTHER PUBLICATIONS

U.S. Appl. No. 11/208,720 to Hwang et al., which was filed on Aug. 23, 2005.
U.S. Appl. No. 11/208,529 to Hwang et al., which was filed on Aug. 23, 2005.
U.S. Appl. No. 11/111,850 to Hwang et al., which was filed on Apr. 22, 2005.

* cited by examiner

*Primary Examiner*—Thomas Denion
*Assistant Examiner*—Douglas J. Duff
(74) *Attorney, Agent, or Firm*—Greenblum & Bernstein, P.L.C.

(57) ABSTRACT

Disclosed herein is a capacity-changing unit of an orbiting vane compressor that is capable of selectively accomplishing compression or communication in inner and outer compression chambers of a cylinder through simple manipulation of a valve, thereby easily changing the capacity of the orbiting vane compressor. The capacity-changing unit includes a smart control valve comprising a valve body disposed on the cylinder, a first actuating part formed at one side of the valve body for performing compression and communication in the inner compression chamber of the cylinder, and a second actuating part formed at the other side of the valve body for performing compression and communication in the outer compression chamber of the cylinder.

19 Claims, 10 Drawing Sheets

PRIOR ART

PRIOR ART

PRIOR ART

CAPACITY-CHANGING UNIT OF ORBITING VANE COMPRESSOR

BACKGROUND OF THE INVENTION

1. Field of the Invention

The present invention relates to an orbiting vane compressor, and, more particularly, to a capacity-changing unit of an orbiting vane compressor having inner and outer compression chambers formed at the inside and the outside of a circular vane as the circular vane performs an orbiting movement in a cylinder that is capable of selectively accomplishing compression or communication in the inner and outer compression chambers of the cylinder through simple manipulation of a valve, thereby easily changing the capacity of the orbiting vane compressor.

2. Description of the Related Art

Generally, an orbiting vane compressor is constructed to form inner and outer compression chambers in a cylinder as an orbiting vane performs an orbiting movement in the cylinder. FIG. 1 illustrates a low-pressure sealed type refrigerant compressor that is applicable as a sealed type refrigerant compressor, such as is used in a refrigerator or an air conditioner, which has been proposed by the applicant of the present application.

As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the lower part thereof. The crank pin 81 is fixedly fitted in the boss 55 of the orbiting vane 5. As the orbiting vane 5 performs an orbiting movement in a cylinder 4, refrigerant gas introduced into the cylinder 4 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

The illustrated conventional orbiting vane compressor is a low-pressure orbiting vane compressor wherein refrigerant gas compressed by the compression unit P is discharged to a high-pressure chamber 12 formed at the upper part of the shell 1 through the inner and outer outlet ports 44 and 44*a* of the cylinder 4. An outlet tube 13, which penetrates the shell 1, communicates with the high-pressure chamber 12. An inlet tube 11 is disposed below the outlet tube 13. Specifically, the inlet tube 11 penetrates the shell 1 such that the inlet tube 11 communicates with one side of the main frame 6.

When electric current is supplied to the drive unit D, the rotor 3 of the drive unit D is rotated, and therefore, the crankshaft 8 is also rotated. As the crankshaft 8 is rotated, the orbiting vane 5 of the compression unit P performs an orbiting movement along the annular space 42 defined between the inner ring 41 and the inner wall of the cylinder 4 while the crank pin 81 of the crankshaft 8 is eccentrically fitted in the boss 55 formed at the lower part of the orbiting vane 5.

As a result, the circular vane 51 of the orbiting vane 5, which is inserted in the annular space 42 defined between the inner ring 41 and the inner wall of the cylinder 4, also performs an orbiting movement to compress refrigerant gas introduced into the annular space 42. At this time, the inner and outer compression chambers are formed at the inside and the outside of the circular vane 51 in the annular space 41, respectively. Refrigerant gases compressed in the inner and outer compression chambers are guided to the high-pressure chamber 12 through the inner and outer outlet ports 44 and 44*a* formed at the upper part of the cylinder 4, which communicate with the inner and outer compression chambers, respectively, and are then discharged out of the orbiting vane compressor through the outlet tube 13. In this way, high-temperature and high-pressure refrigerant gas is discharged.

FIG. 2 is an exploded perspective view illustrating the structure of the compression unit of the conventional orbiting vane compressor shown in FIG. 1.

In the compression unit P of the orbiting vane compressor, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. The through-hole 52 is opened to the upper part of the circular vane 51 and to a slider 54. The slider 54 is disposed in an opening 53, which is formed at another predetermined position of the circumferential part of the circular vane 51 of the orbiting vane 5 while being adjacent to the position where the through-hole 52 is formed, for maintaining the seal between low-pressure and high-pressure sides defined in the cylinder 4.

FIG. 3 is a cross-sectional view illustrating the compressing operation of the compression unit of the conventional orbiting vane compressor shown in FIG. 2.

When the orbiting vane 5 of the compression unit P is driven by power transmitted to the compression unit P from the drive unit D through the crankshaft 8 (see FIG. 1), the circular vane 51 of the orbiting vane 5 disposed in the annular space 42 of the cylinder 4 performs an orbiting movement in the annular space 42 defined between the inner ring 41 and the inner wall of the cylinder 4, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 through the inlet port 43 and the through-hole 52 of the circular vane 51, and compression is performed in an outer compression chamber B2 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2.

At the 90-degree orbiting position of the orbiting vane 5 of the compression unit P, the compression is still performed in the outer compression chamber B2, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 through the outer outlet port 44*a*, and the compression is still performed in the inner compression chamber A2. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is performed in a continuous fashion.

Meanwhile, an energy-saving operation of a refrigerating apparatus or an air conditioning apparatus, such as a refrigerator or an air conditioner, is generally performed as follows. When the temperature in the refrigerator or the temperature in a room where the air conditioner is installed reaches a predetermined temperature, the operation of the compressor of the refrigerator or the air conditioner is stopped. When the temperature in the refrigerator or the temperature in the room exceeds the predetermined temperature, on the other hand, the operation of the compressor of the refrigerator or the air conditioner is initiated. In this way, the operation of the compressor is repetitively turned on and off. Generally, power consumption when the operation of the compressor is initiated is greater than power consumption when the compressor is normally operated. Furthermore, interference between the compressed gas in the compressor and the parts of the compressor is caused due to abrupt interruption of the compressor and initiation of the compressor, and therefore, the parts of the compressor are prematurely worn, which reduces the service life of the compressor.

For this reason, it is required to change the capacity of the compressor without performing repetitive on/off operation of the compressor as described above. An inverter system may be used to change the capacity of the compressor. In the inverter system, the number of rotations of the motor is controlled to change the capacity of the compressor. However, the inverter system has problems in that expensive electric circuit control devices and relevant parts are needed. Consequently, the manufacturing costs of the compressor are increased, and therefore, the competitiveness of the product is decreased.

SUMMARY OF THE INVENTION

Therefore, the present invention has been made in view of the above problems, and it is an object of the present invention to provide a capacity-changing unit of an orbiting vane compressor having inner and outer compression chambers formed at the inside and the outside of a circular vane as the circular vane performs an orbiting movement in a cylinder that is capable of selectively accomplishing compression or communication in the inner and outer compression chambers of the cylinder through simple manipulation of a valve, thereby easily changing the capacity of the orbiting vane compressor.

It is another object of the present invention to provide a capacity-changing unit of an orbiting vane compressor that is capable of accomplishing compression and communication in either the inner compression chamber or the outer compression chamber of the cylinder through simple manipulation of the valve.

It is yet another object of the present invention to provide a capacity-changing unit of an orbiting vane compressor that is capable of selectively or simultaneously accomplishing compression and communication in the inner and outer compression chambers of the cylinder through simple manipulation of the valve.

In accordance with the present invention, the above and other objects can be accomplished by the provision of a capacity-changing unit of an orbiting vane compressor, comprising: inner and outer compression chambers formed in a cylinder, the inner and outer compression chambers being divided from each other by a circular vane of an orbiting vane disposed in an annular space defined in the cylinder; inner and outer inlet ports formed at the upper part of the cylinder, the inner and outer inlet ports communicating with the inner and outer compression chambers, respectively; inner and outer outlet ports formed at the upper part of the cylinder, the inner and outer outlet ports communicating with the inner and outer compression chambers, respectively; and a smart control valve comprising: a valve body disposed on the cylinder; a first actuating part formed at one side of the valve body for performing compression and communication in the inner compression chamber of the cylinder; and a second actuating part formed at the other side of the valve body for performing compression and communication in the outer compression chamber of the cylinder.

Preferably, the valve body has valve inlet and outlet ports formed at both sides thereof, respectively, the valve inlet port corresponding to the inner and outer inlet ports of the cylinder and the valve outlet port corresponding to the inner and outer outlet ports of the cylinder.

Preferably, the capacity-changing unit further comprises: an actuating groove disposed under the valve inlet port and the valve outlet port, the actuating groove being opened at one side thereof; and an actuator disposed in the actuating groove for performing a linear reciprocating movement in the actuating groove as a solenoid disposed at the opened side of the actuating groove is operated.

Preferably, the actuator includes: a discharge side opening/closing hole formed at the other longitudinal side thereof for allowing or interrupting communication between the valve outlet port and the inner and outer outlet ports of the cylinder; and a communication groove formed at the other longitudinal side thereof, the communication groove having an open side.

Preferably, the actuator includes: a discharge side opening/closing hole formed at the other longitudinal side thereof for allowing or interrupting communication between the valve outlet port and the inner and outer outlet ports of the cylinder; an elongated suction hole formed at the other longitudinal side thereof for maintaining communication between the valve inlet port and the inner and outer inlet ports of the cylinder; and a communication groove disposed under the elongated suction hole, the communication groove extending toward the discharge side opening/closing hole and opposite ends of the communication groove being closed.

Preferably, the actuator includes: a communication groove formed at the lower part thereof, opposite ends of the communication groove being closed; a suction side opening/closing hole disposed above the communication groove adjacent to one side of the lower communication groove, the suction side opening/closing hole communicating with the communication groove; a communication hole disposed above the communication groove adjacent to the other side of the lower communication groove, the communication hole communicating with the communication groove; and a discharge side opening/closing hole disposed adjacent to the communication hole for allowing or interrupting communication between the valve outlet port and the inner and outer outlet ports of the cylinder.

Preferably, the actuator includes: a discharge side opening/closing hole formed at one longitudinal side thereof for allowing or interrupting communication between the valve outlet port and the inner and outer outlet ports of the cylinder; an elongated suction hole formed at the other longitudinal side thereof for maintaining communication between the valve inlet port and the inner and outer inlet ports of the cylinder; a communication groove formed at the lower part thereof between the elongated suction hole and the discharge side opening/closing hole, opposite ends of the communication groove being closed; and a suction guide disposed between the elongated suction hole and the communication groove, and the cylinder includes an upper open groove disposed between the inner and outer inlet ports thereof and the inner and outer outlet ports thereof, the upper open groove being opposite to the communication groove of the actuator.

Preferably, the actuator includes: a discharge side opening/closing hole formed at one longitudinal side thereof for allowing or interrupting communication between the valve outlet port and the inner and outer outlet ports of the cylinder; a suction side opening/closing hole formed at the other longitudinal side thereof for allowing or interrupting communication between the valve inlet port and the inner and outer inlet ports of the cylinder; a communication hole disposed between the suction side opening/closing hole and the discharge side opening/closing hole; a first communication groove disposed under the suction side opening/closing hole, the first communication groove communicating with the suction side opening/closing hole and opposite ends of the first communication groove being closed; a second communication groove disposed under the communication hole, the second communication groove communicating with the communication hole and opposite ends of the second communication groove being closed; and a suction guide disposed between the first communication groove and the second communication groove, and the cylinder includes an upper open groove disposed between the inner and outer inlet ports thereof and the inner and outer outlet ports thereof, the upper open groove being opposite to the second communication groove of the actuator.

Preferably, the actuator includes: first and second discharge side opening/closing holes formed at one longitudinal side thereof for allowing or interrupting communication between the valve outlet port and the inner and outer outlet ports of the cylinder; an elongated suction hole formed at the other longitudinal side thereof for maintaining communication between the valve inlet port and the inner and outer inlet ports of the cylinder; a communication groove formed at the lower part thereof between the elongated suction hole and the first discharge side opening/closing hole, the communication groove communicating with the second discharge side opening/closing hole and opposite ends of the communication groove being closed; and a suction guide disposed between the elongated suction hole and the communication groove, and the cylinder includes an upper open groove disposed between the inner and outer inlet ports thereof and the inner and outer outlet ports thereof, the upper open groove being opposite to the communication groove of the actuator.

Preferably, the smart control valve is constructed such that the first actuating part and the second actuating part are actuated symmetrically to each other.

Preferably, the smart control valve is constructed such that the first actuating part and the second actuating part are actuated in the same direction.

BRIEF DESCRIPTION OF THE DRAWINGS

The above and other objects, features and other advantages of the present invention will be more clearly understood from the following detailed description taken in conjunction with the accompanying drawings, in which:

FIGS. 5A to 5C illustrate a capacity-changing unit of an orbiting vane compressor according to a first preferred embodiment of the present invention, in which FIG. 5A is a perspective view illustrating an actuator, FIG. 5B is a sectional view illustrating a compression state, and FIG. 5C is a sectional view illustrating a communication state;

FIGS. 6A to 6C illustrate a capacity-changing unit of an orbiting vane compressor according to a second preferred embodiment of the present invention, in which FIG. 6A is a perspective view illustrating an actuator, FIG. 6B is a sectional view illustrating a compression state, and FIG. 6C is a sectional view illustrating a communication state;

FIGS. 7A to 7C illustrate a capacity-changing unit of an orbiting vane compressor according to a third preferred embodiment of the present invention, in which FIG. 7A is a perspective view illustrating an actuator, FIG. 7B is a sectional view illustrating a compression state, and FIG. 7C is a sectional view illustrating a communication state;

FIGS. 8A to 8C illustrate a capacity-changing unit of an orbiting vane compressor according to a fourth preferred embodiment of the present invention, in which FIG. 8A is a perspective view illustrating an actuator, FIG. 8B is a sectional view illustrating a compression state, and FIG. 8C is a sectional view illustrating a communication state;

FIGS. 9A to 9C illustrate a capacity-changing unit of an orbiting vane compressor according to a fifth preferred embodiment of the present invention, in which FIG. 9A is a perspective view illustrating an actuator, FIG. 9B is a sectional view illustrating a compression state, and FIG. 9C is a sectional view illustrating a communication state; and FIGS. 10A to 10C illustrate a capacity-changing unit of an orbiting vane compressor according to a sixth preferred embodiment of the present invention, in which FIG. 10A is a perspective view illustrating an actuator, FIG. 10B is a sectional view illustrating a compression state, and FIG. 10C is a sectional view illustrating a communication state.

DESCRIPTION OF THE PREFERRED EMBODIMENTS

Now, preferred embodiments of the present invention will be described in detail with reference to the accompanying drawings.

Figure 1:
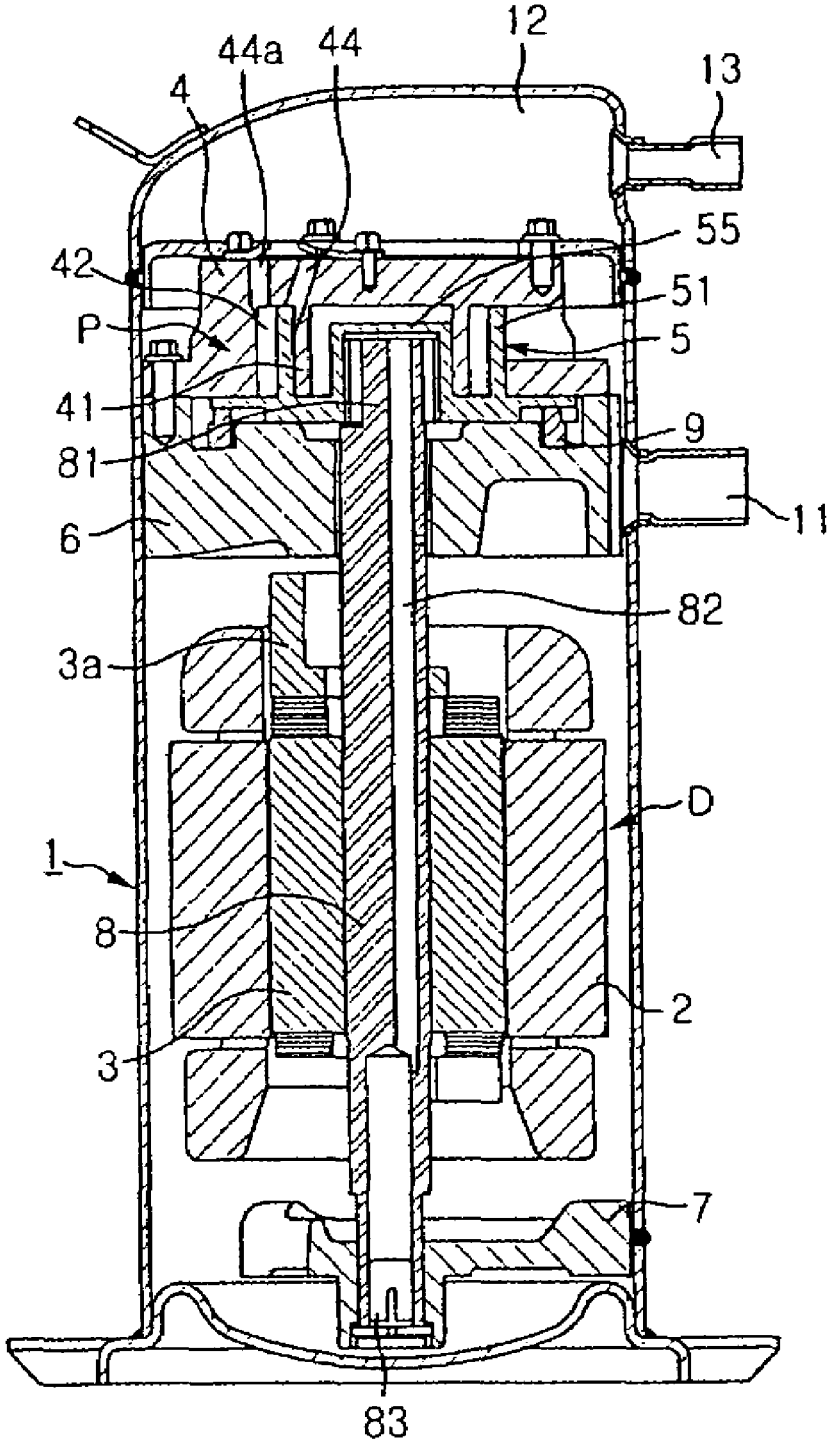
FIG. 1 is a longitudinal sectional view illustrating the overall structure of a conventional orbiting vane compressor.
Figure 2:
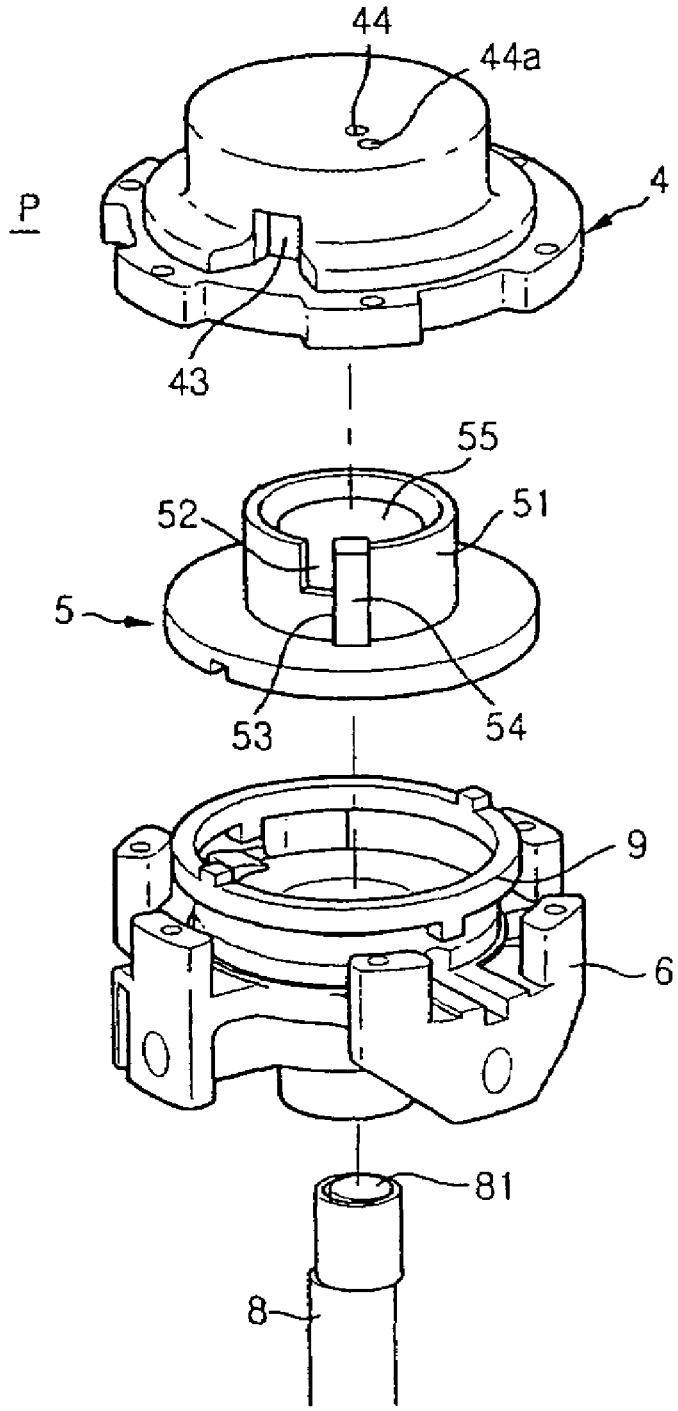
FIG. 2 is an exploded perspective view illustrating the structure of the compression unit of the conventional orbiting vane compressor shown in FIG. 1.
Figure 3:
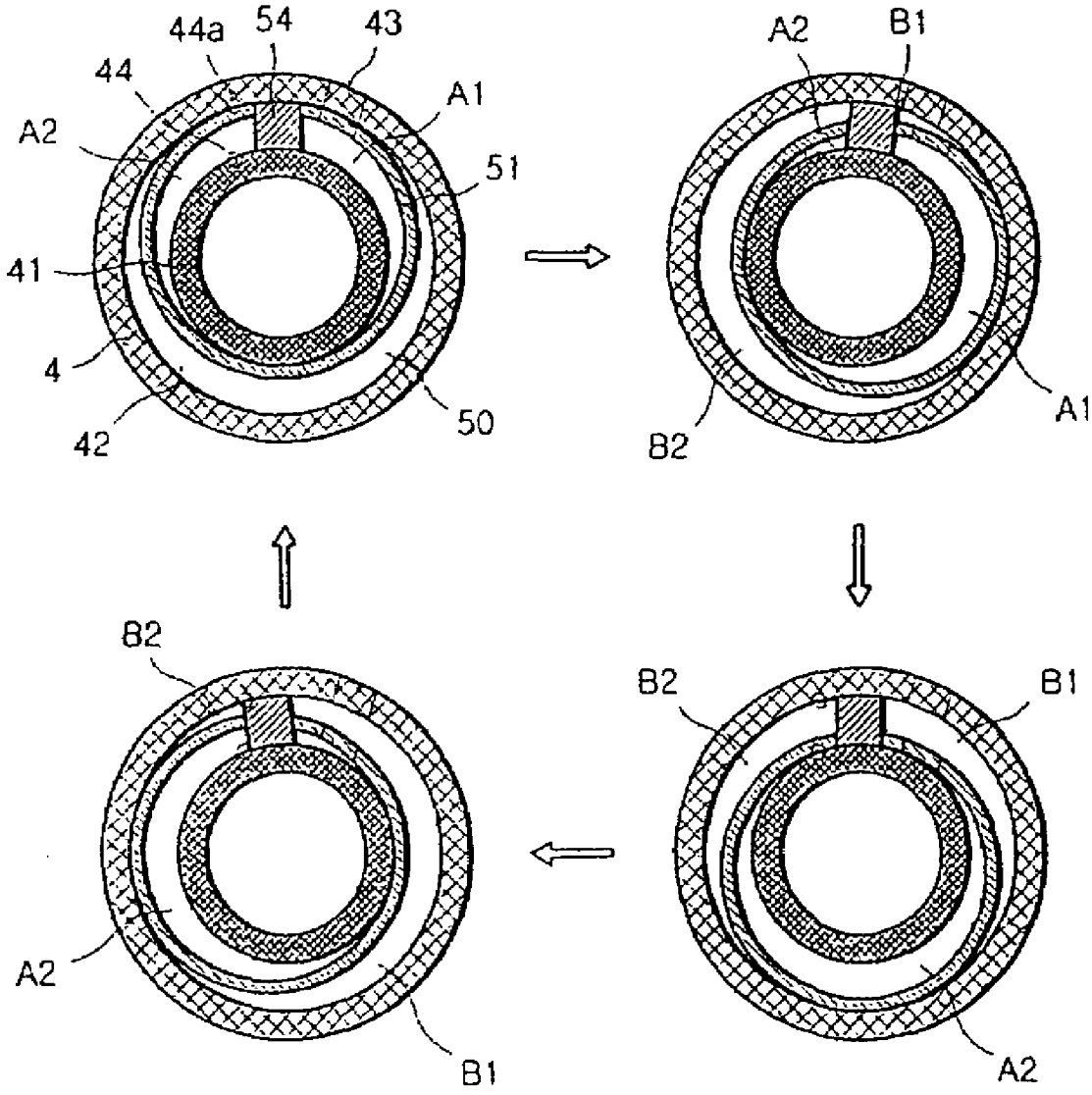
FIG. 3 is a cross-sectional view illustrating the compressing operation of the compression unit of the conventional orbiting vane compressor shown in FIG. 2.
Figure 4:
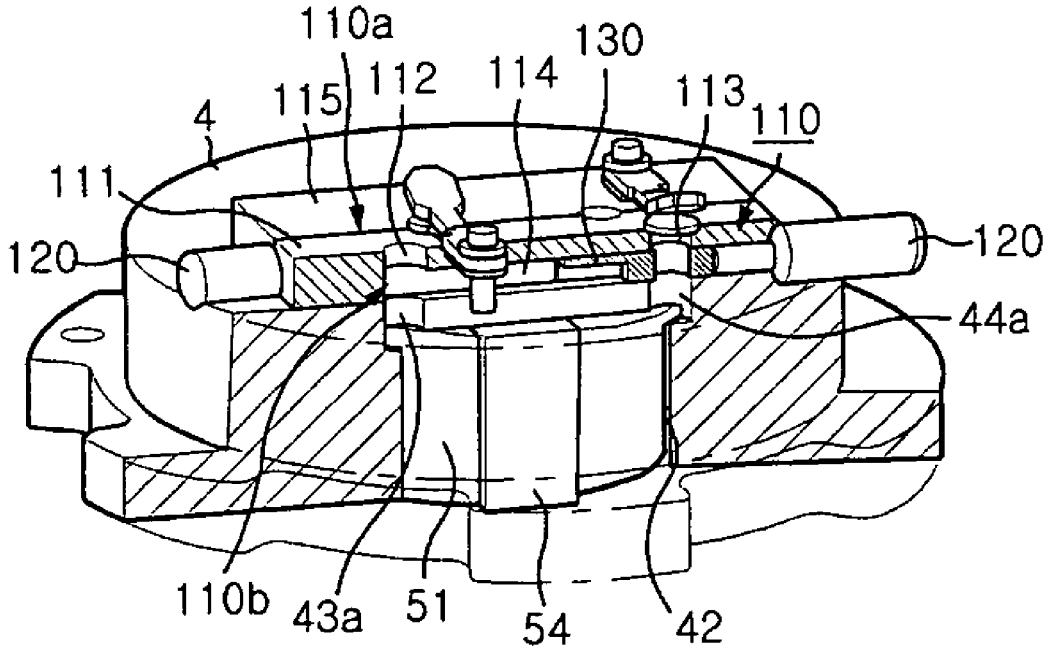
FIG. 4 is a perspective view, partially cut away, illustrating a cylinder of an orbiting vane compressor to which a capacity-changing unit according to the present invention is applied.

FIG. 4 is a perspective view, partially cut away, illustrating a cylinder of an orbiting vane compressor to which a capacity-changing unit according to the present invention is applied.

In the orbiting vane compressor as shown in FIG. 4, inner and outer compression chambers are formed at the inside and the outside of a circular vane 51 as the circular vane 51, which is disposed in an annular space 42 defined in a cylinder 4, performs an orbiting movement in the annular space 42. At the upper part of the cylinder 4 adjacent to one side of a slider 54 of the circular vane 51 are formed inner and outer inlet ports. At the upper part of the cylinder 4 adjacent to the other side of the slider 54 of the circular vane 51 are formed inner and outer outlet ports. In the drawing, only the outer inlet port, which is indicated by reference numeral 43*a*, and the outer outlet port, which is indicated by reference numeral 44*a*, are illustrated.

According to the present invention, a smart control valve 110 is mounted on the upper surface of the cylinder 4 of the circular vane compressor such that compression is performed in both the inner and outer compression chambers or compression is performed only in either the inner compression chamber or the outer compression chamber by the manipulation of the smart control valve 110 to change the capacity of the orbiting vane compressor.

The smart control valve 110 comprises: a valve body 111; a first actuating part 110*a* formed at one side of the valve body 111 for performing compression and communication in the inner compression chamber; and a second actuating part 110*b* formed at the other side of the valve body 111 for performing compression and communication in the outer compression chamber.

The first actuating part 110*a* and the second actuating part 110*b* have the same structure. At both sides of the valve body 111 are formed a valve inlet port 112, which corresponds to the inner and outer inlet ports of the cylinder 4, and a valve outlet port 113, which corresponds to the inner and outer outlet ports of the cylinder 4. Under the valve inlet port 112 and the valve outlet port 113 is disposed an actuating groove 114, which is opened at one side thereof. In the actuating groove 114 is disposed an actuator 130, which is linearly reciprocated by a solenoid 120 for substantially allowing or interrupting communication between the inner and outer inlet ports of the cylinder 4 and the inner and outer outlet ports of the cylinder 4.

The illustrated smart control valve 110 is a symmetrical smart control valve wherein the first actuating part 110*a* and the second actuating part 110*b* are actuated symmetrically to each other. In this case, the orbiting vane compressor is operated in two-stage mode. Specifically, compression is not performed in both the inner and outer compression chambers but only in either the inner compression chamber or the outer compression chamber. The two-stage mode operation is accomplished by an orbiting movement of the circular valve 51 in alternating directions. The inner inlet port (not shown) and the outer inlet port 43*a* of the cylinder 4 are disposed opposite to each other while being symmetrical to each other. Similarly, the inner outlet port (not shown) and the outer outlet port 44*a* of the cylinder 4 are also disposed opposite to each other while being symmetrical to each other.

Unexplained reference numeral 115 indicates a valve side cover. The valve side cover 115 is attached to either lateral side of the valve body 111 of the smart control valve 110, as shown in FIG. 4. In this case, manufacturing and assembling efficiency of the smart control valve 110 is improved. However, the smart control valve 110 is not limited to the illustrated structure, and therefore, the smart control valve 110 may take various different forms.

Now, the structure and operation of the actuator according to the present invention will be described in detail with reference to the accompanying drawings. As described above, the first actuating part 110*a* of the smart control valve 110 is identical in construction and operation to the second actuating part 110*b* of the smart control valve 110, and therefore, only the second actuating part 110*b* of the smart control valve 110 will be hereinafter described.

Figure 5A:
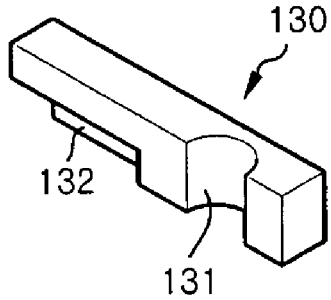
Figure 5B:
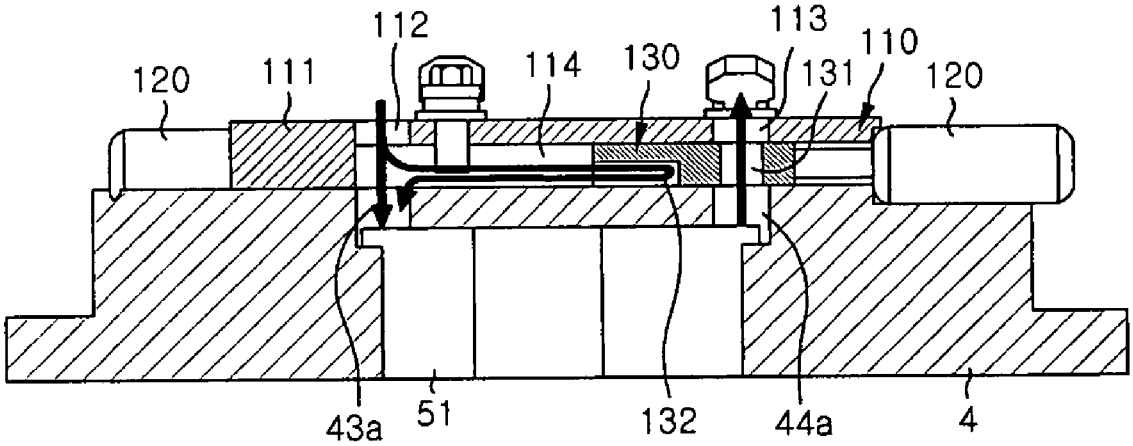
Figure 5C:
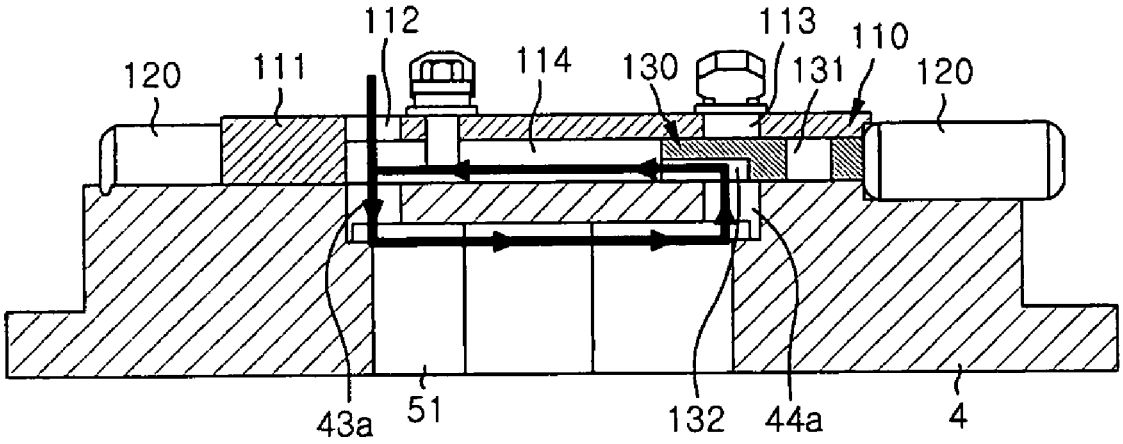

FIGS. 5A to 5C illustrate a capacity-changing unit of an orbiting vane compressor according to a first preferred embodiment of the present invention.

FIG. 5A is a perspective view illustrating an actuator 130. As shown in FIG. 5A, the actuator 130 has a discharge side opening/closing hole 131 formed at one longitudinal side of the actuator 130. The discharge side opening/closing hole 131 vertically extends through the actuator 130. Also, the actuator 130 has a communication groove 132 formed at the other longitudinal side of the actuator 130. One side of the communication groove 132 is opened. The actuator 130 is connected to a solenoid 120, as shown in FIG. 5B. The actuator 130 performs a linear reciprocating movement in the actuating groove 114 of the valve body 111, as the solenoid 120 is operated, to accomplish compression and communication in the outer compression chamber of the cylinder 4, which will be described below in more detail with reference to FIGS. 5B and 5C.

When the actuator 130 is moved forward by the solenoid 120, as shown in FIG. 5B, the discharge side opening/closing hole 131 is aligned with the outer outlet port 44*a* of the cylinder 4 and the valve outlet port 113. As a result, the outer outlet port 44*a* of the cylinder 4 communicates with the valve outlet port 113 through the discharge side opening/closing hole 131. At this time, the communication groove 132 does not communicate with the outer outlet port 44*a* of the cylinder 4.

Consequently, refrigerant gas introduced into the valve body 111 through the valve inlet port 112 flows along the actuating groove 114 and the communication groove 132, and then flows backward into the cylinder 4 through the outer inlet port 43*a* of the cylinder 4. The refrigerant gas introduced into the cylinder 4 through the outer inlet port 43*a* of the cylinder 4 is compressed by an orbiting movement of the circular vane 51. The compressed refrigerant is discharged out of the cylinder 4 through the outer outlet port 44*a* of the cylinder 4, the discharge side opening/closing hole 131 of the actuator 130, and the valve outlet port 113. In this way, compression in the outer compression chamber of the cylinder is accomplished.

When the actuator 130 is moved rearward by the solenoid 120, as shown in FIG. 5C, on the other hand, the discharge side opening/closing hole 131 of the actuator 130 is not aligned with the outer outlet port 44*a* of the cylinder 4 and the valve outlet port 113. As a result, the outer outlet port 44*a* of the cylinder 4 does not communicate with the valve outlet port 113. Consequently, refrigerant gas introduced into the cylinder 4 through the valve inlet port 112 and the outer inlet port 43*a* of the cylinder 4 is compressed by an orbiting movement of the circular vane 51. However, the compressed refrigerant is not discharged out of the cylinder 4. Specifically, the compressed refrigerant is circulated along the actuating groove 114 of the valve body 111 through the communication groove 132. As a result, the outer inlet port 43*a* of the cylinder 4 communicates with the outer outlet port 44*a* of the cylinder 4.

The illustrated smart control valve 110 is a symmetrical smart control valve wherein the first actuating part (not shown) and the second actuating part 110*b* are disposed symmetrically about the valve body 111. In this case, the orbiting vane compressor is operated in the two-stage mode as described above. Specifically, compression is performed in either the inner compression chamber or the outer compression chamber.

Figure 6A:
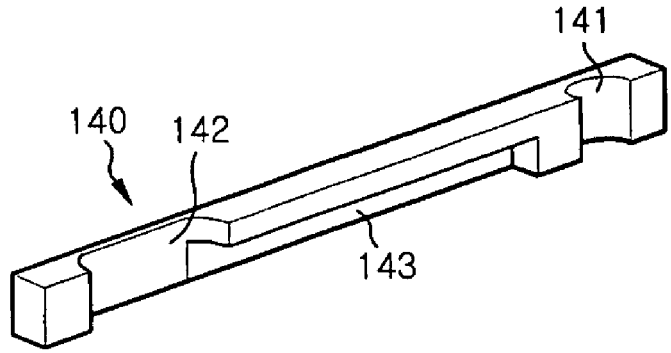
Figure 6B:
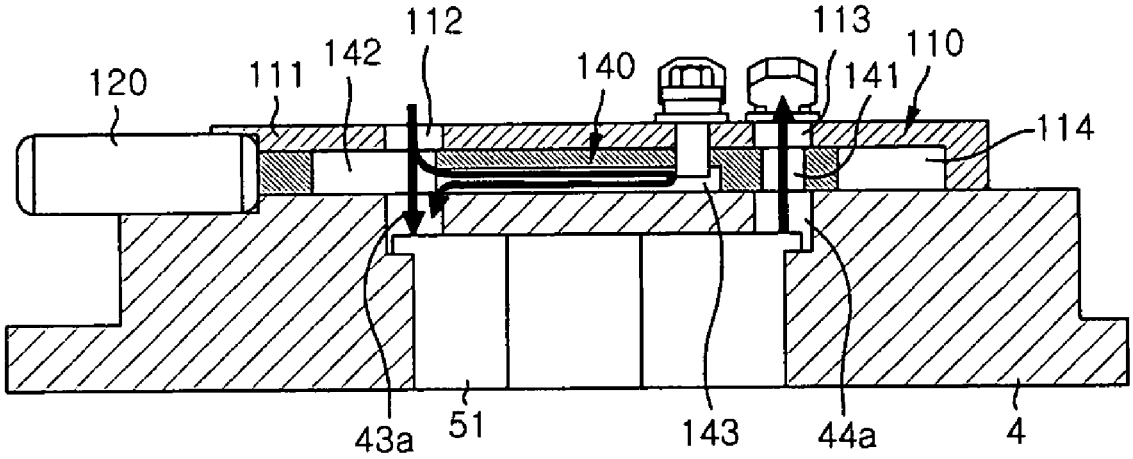
Figure 6C:
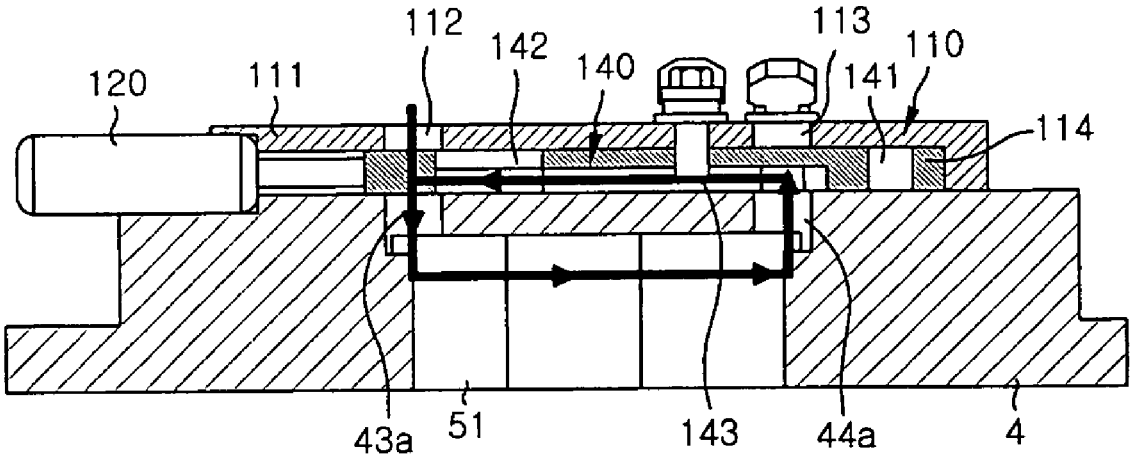

FIGS. 6A to 6C illustrate a capacity-changing unit of an orbiting vane compressor according to a second preferred embodiment of the present invention.

FIG. 6A is a perspective view illustrating an actuator 140. As shown in FIG. 6A, the actuator 140 has a discharge side opening/closing hole 141 formed at one longitudinal side of the actuator 140. The discharge side opening/closing hole 141 vertically extends through the actuator 140. Also, the actuator 140 has an elongated suction hole 142 formed at the other longitudinal side of the actuator 140. The elongated suction hole 142 has an elliptical section. Under the elongated suction hole 142 is disposed a communication groove 143, which extends toward the discharge side opening/closing hole 141. Opposite ends of the communication groove 143 are closed. The communication groove 143 communicates with the elongated suction hole 142. However, the communication groove 143 does not communicate with the discharge side opening/closing hole 141.

When the actuator 140 is moved rearward by the solenoid 120, as shown in FIG. 6B, the discharge side opening/closing hole 141 is aligned with the outer outlet port 44*a* of the cylinder 4 and the valve outlet port 113. As a result, the outer outlet port 44*a* of the cylinder 4 communicates with the valve outlet port 113 through the discharge side opening/closing hole 141. At this time, the communication groove 143 does not communicate with the outer outlet port 44*a* of the cylinder 4.

Consequently, refrigerant gas introduced into the communication groove 143 of the actuator 140 through the valve inlet port 112 flows along the communication groove 143, and then flows backward into the cylinder 4 through the outer inlet port 43*a* of the cylinder 4. The refrigerant gas introduced into the cylinder 4 through the outer inlet port 43*a* of the cylinder 4 is compressed by an orbiting movement of the circular vane 51. The compressed refrigerant is discharged out of the cylinder 4 through the outer outlet port 44*a* of the cylinder 4, the discharge side opening/closing hole 141 of the actuator 140, and the valve outlet port 113. In this way, compression in the outer compression chamber of the cylinder is accomplished.

When the actuator 140 is moved forward by the solenoid 120, as shown in FIG. 6C, on the other hand, the discharge side opening/closing hole 141 of the actuator 140 is not aligned with the outer outlet port 44*a* of the cylinder 4 and the valve outlet port 113. At this time, the communication groove 143 communicates with the outer outlet port 44*a* of the cylinder 4. Consequently, refrigerant gas introduced into the communication groove 143 of the actuator 140 through the valve inlet port 112 is introduced into the cylinder 4 through the outer inlet port 43*a* of the cylinder 4.

The refrigerant gas introduced into the cylinder 4 is compressed by an orbiting movement of the circular vane 51. However, the compressed refrigerant is not discharged out of the cylinder 4. Specifically, the compressed refrigerant is circulated along the communication groove 143 of the actuator 140. As a result, the outer inlet port 43*a* of the cylinder 4 communicates with the outer outlet port 44*a* of the cylinder 4.

The illustrated smart control valve 110 is a valve wherein the first actuating part (not shown) and the second actuating part 110*b* are actuated in the same direction. In this case, the orbiting vane compressor is operated in three-stage mode. Specifically, compression is performed in both the inner and outer compression chambers or compression is performed only in either the inner compression chamber or the outer compression chamber.

Figure 7A:
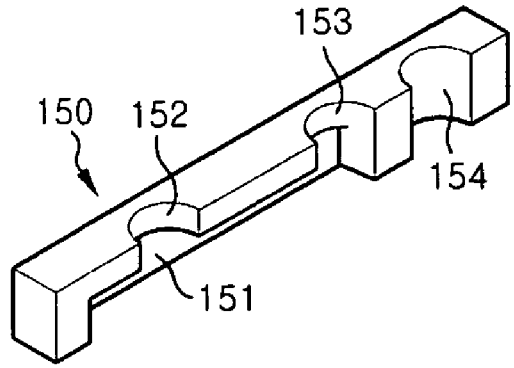
Figure 7B:
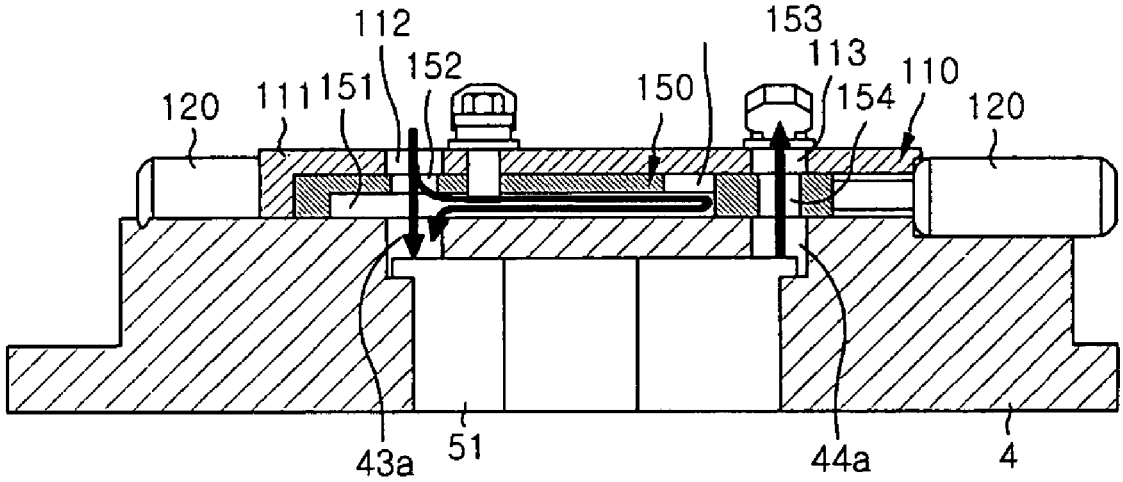
Figure 7C:
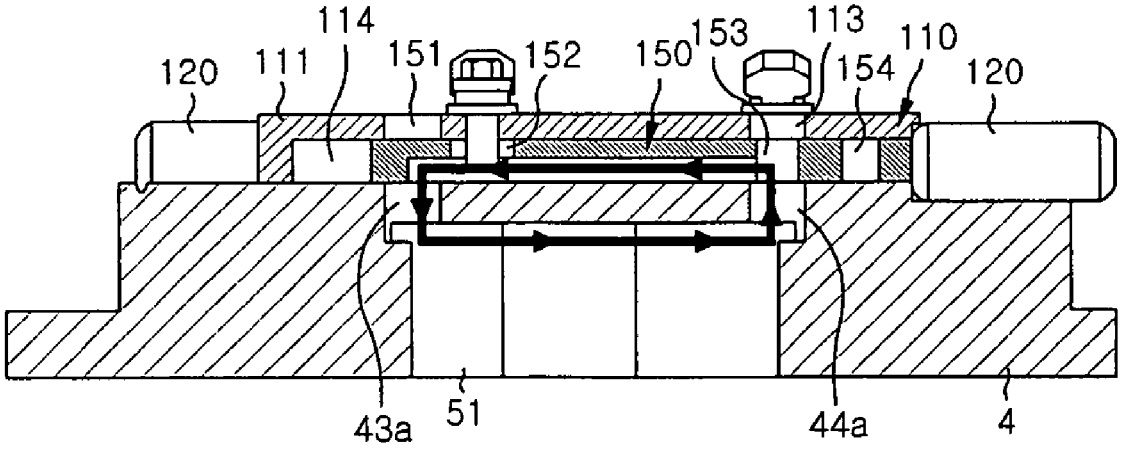

FIGS. 7A to 7C illustrate a capacity-changing unit of an orbiting vane compressor according to a third preferred embodiment of the present invention.

FIG. 7A is a perspective view illustrating an actuator 150. As shown in FIG. 7A, the actuator 150 has a communication groove 151, which is formed at the lower part of the actuator 150 and opposite ends of which are closed, and a suction side opening/closing hole 152, which is disposed above the lower communication groove 151 adjacent to one side of the lower communication groove 151. The suction side opening/closing hole 152 communicates with the lower communication groove 151. In addition, the actuator 150 has a communication hole 153, which is disposed above the lower communication groove 151 adjacent to the other side of the lower communication groove 151. The communication hole 153 communicates with the lower communication groove 151. At the actuator 150 is also formed a discharge side opening/closing hole 154, which is disposed adjacent to the communication hole 153. The discharge side opening/closing hole 154 vertically extends through the actuator 150.

When the actuator 150 is moved forward by the solenoid 120, as shown in FIG. 7B, the discharge side opening/closing hole 154 is aligned with the outer outlet port 44*a* of the cylinder 4 and the valve outlet port 113. As a result, the outer outlet port 44*a* of the cylinder 4 communicates with the valve outlet port 113 through the discharge side opening/closing hole 154. At this time, the communication groove 151 and the communication hole 153 do not communicate with the outer outlet port 44*a* of the cylinder 4.

Consequently, refrigerant gas introduced into the communication groove 151 of the actuator 150 through the valve inlet port 112 and the suction side opening/closing hole 152 flows along the communication groove 151, and then flows backward into the cylinder 4 through the outer inlet port 43*a* of the cylinder 4. The refrigerant gas introduced into the cylinder 4 through the outer inlet port 43*a* of the cylinder 4 is compressed by an orbiting movement of the circular vane 51. The compressed refrigerant is discharged out of the cylinder 4 through the outer outlet port 44*a* of the cylinder 4, the discharge side opening/closing hole 154 of the actuator 150, and the valve outlet port 113. In this way, compression in the outer compression chamber of the cylinder is accomplished.

When the actuator 150 is moved rearward by the solenoid 120, as shown in FIG. 7C, on the other hand, the discharge side opening/closing hole 154 and the suction side opening/closing hole 152 of the actuator 150 are not aligned with the outer outlet port 44*a* of the cylinder 4 and the valve outlet port 113, and the valve inlet port 112, respectively. At this time, the communication groove 151 and the communication hole 153 communicate with the outer inlet port 43*a* of the cylinder 4, and the outer outlet port 44*a* of the cylinder 4 and the valve outlet port 113, respectively.

Consequently, refrigerant gas introduced into the cylinder 4 through the outer inlet port 43*a* of the cylinder 4 is compressed, and is then discharged out of the cylinder 4 through the outer outlet port 44*a* of the cylinder 4, the communication hole 153 of the actuator 150, and the valve outlet port 113. While introduction of the refrigerant gas through the valve inlet port 112 is interrupted, the refrigerant gas in the cylinder 4 is repetitively circulated and discharged through the communication groove 151 of the actuator 150. In this way, the outer inlet port 43*a* of the cylinder 4 communicates with the outer outlet port 44*a* of the cylinder 4 through the communication groove 151 of the actuator 150.

The illustrated smart control valve 110 is a symmetrical smart control valve wherein the first actuating part (not shown) and the second actuating part 110*b* are disposed symmetrically about the valve body 111. In this case, the orbiting vane compressor is operated in the two-stage mode as described above. Specifically, compression is performed in either the inner compression chamber or the outer compression chamber.

Figure 8A:
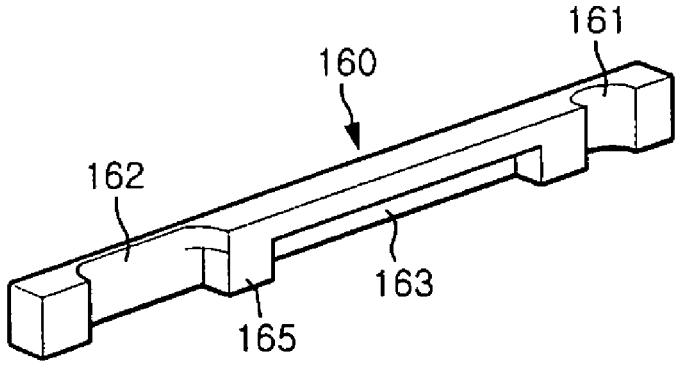
Figure 8B:
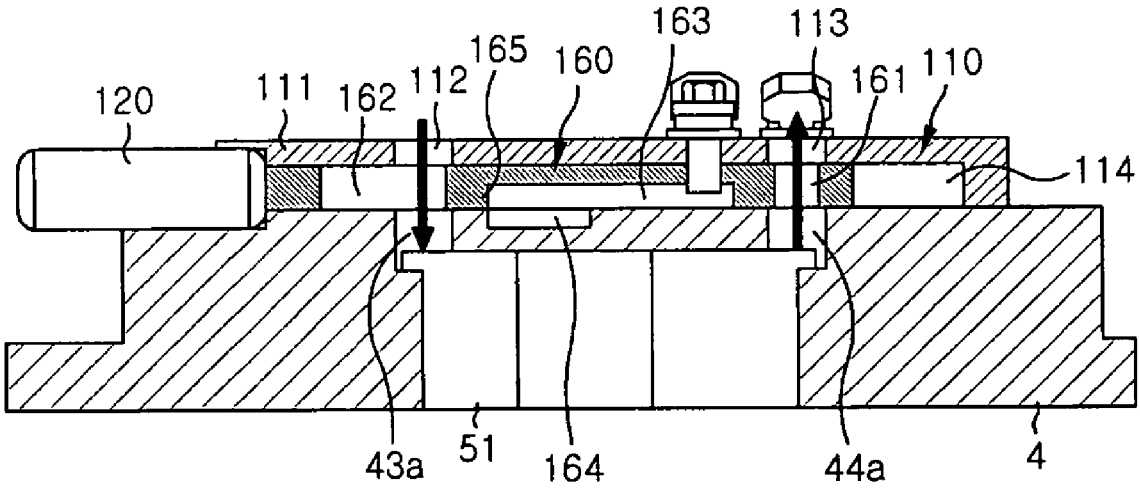
Figure 8C:
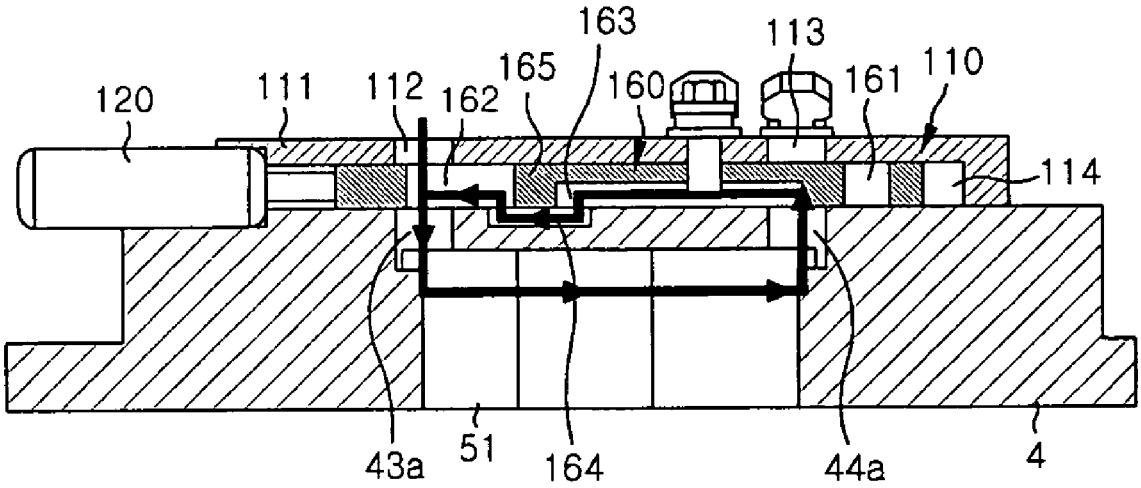

FIGS. 8A to 8C illustrate a capacity-changing unit of an orbiting vane compressor according to a fourth preferred embodiment of the present invention.

FIG. 8A is a perspective view illustrating an actuator 160. As shown in FIG. 8A, the actuator 160 has a discharge side opening/closing hole 161 formed at one longitudinal side of the actuator 160. The discharge side opening/closing hole 161 vertically extends through the actuator 160. Also, the actuator 160 has an elongated suction hole 162 formed at the other longitudinal side of the actuator 160. The elongated suction hole 162 has an elliptical section. At the lower part of the actuator 160, between the elongated suction hole 162 and the discharge side opening/closing hole 161, is formed a communication groove 163, opposite ends of which are closed. The communication groove 163 does not communicate with the elongated suction hole 162 and discharge side opening/closing hole 161. Between the elongated suction hole 162 and the communication groove 163 is disposed a suction guide 165. Correspondingly, the cylinder 4 has an upper open groove 164, which is disposed between the outer inlet port 43*a* of the cylinder 4 and the outer outlet port 44*a* of the cylinder 4. The upper open groove 164 of the cylinder 4 is opposite to the communication groove 163 of the actuator 160.

When the actuator 160 is moved rearward by the solenoid 120, as shown in FIG. 8B, the discharge side opening/closing hole 161 is aligned with the outer outlet port 44*a* of the cylinder 4 and the valve outlet port 113. As a result, the outer outlet port 44*a* of the cylinder 4 communicates with the valve outlet port 113 through the discharge side opening/closing hole 161. Also, the outer inlet port 43*a* of the cylinder 4 communicates with the valve inlet port 112 through the elongated suction hole 162. At this time, the communication groove 163, which is disposed between the elongated suction hole 162 and the discharge side opening/closing hole 161, does not communicate with the outer inlet port 43*a* of the cylinder 4 as well as the outer outlet port 44*a* of the cylinder 4.

Consequently, refrigerant gas is introduced into the cylinder 4 through the valve inlet port 112, the elongated suction hole.162, and the outer inlet port 43*a* of the cylinder 4. The refrigerant gas introduced into the cylinder 4 is compressed in the outer compression chamber of the cylinder 4, and is then discharged out of the cylinder 4 through the outer outlet port 44*a* of the cylinder 4, the discharge side opening/closing hole 161 of the actuator 160, and the valve outlet port 113. In this way, compression in the outer compression chamber of the cylinder is accomplished.

When the actuator 160 is moved forward by the solenoid 120, as shown in FIG. 8C, on the other hand, the discharge side opening/closing hole 161 of the actuator 160 is not aligned with the outer outlet port 44*a* of the cylinder 4 and the valve outlet port 113. As a result, the outer outlet port 44*a* of the cylinder 4 does not communicate with the valve outlet port 113, and the communication groove 163 communicates with the outer outlet port 44*a* of the cylinder 4. At this time, the outer inlet port 43*a* of the cylinder 4 still communicates with the valve inlet port 112 through the elongated suction hole 162 of the actuator 160. Consequently, refrigerant gas discharged through the outer outlet port 44*a* of the cylinder 4 is introduced into the communication groove 163. Also, the suction guide 165 of the actuator 160 is placed in the upper open groove 164 of the cylinder 4. As a result, the communication groove 163 communicates with the elongated suction hole 162 through the upper open groove 164 of the cylinder 4. Consequently, the refrigerant gas introduced into the communication groove 163 is introduced into the elongated suction hole 162 through the upper open groove 164. In this way, the outer inlet port 43*a* of the cylinder 4 communicates with the outer outlet port 44*a* of the cylinder 4.

When the compression is performed as shown in FIG. 8B, the suction guide 165 serves to prevent low-temperature refrigerant gas introduced through the elongated suction hole 162 of the actuator 160 from flowing to the outer outlet port 44*a* of the cylinder 4, through which compressed high-temperature refrigerant gas is discharged. Consequently, undesired preheating of the low-temperature refrigerant gas is effectively prevented by the provision of the suction guide 165.

The illustrated smart control valve 110 is a valve wherein the first actuating part (not shown) and the second actuating part 110*b* are actuated in the same direction. In this case, the orbiting vane compressor is operated in three-stage mode. Specifically, compression is performed in both the inner and outer compression chambers or compression is performed only in either the inner compression chamber or the outer compression chamber.

Figure 9A:
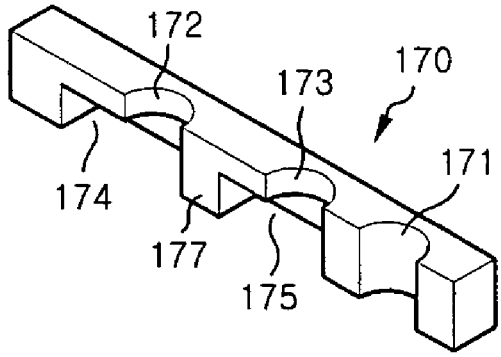
Figure 9B:
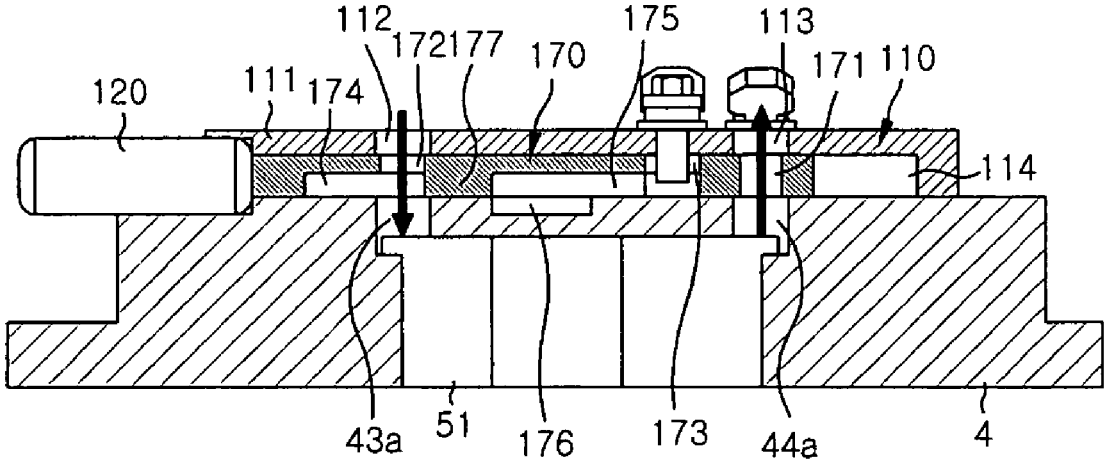
Figure 9C:
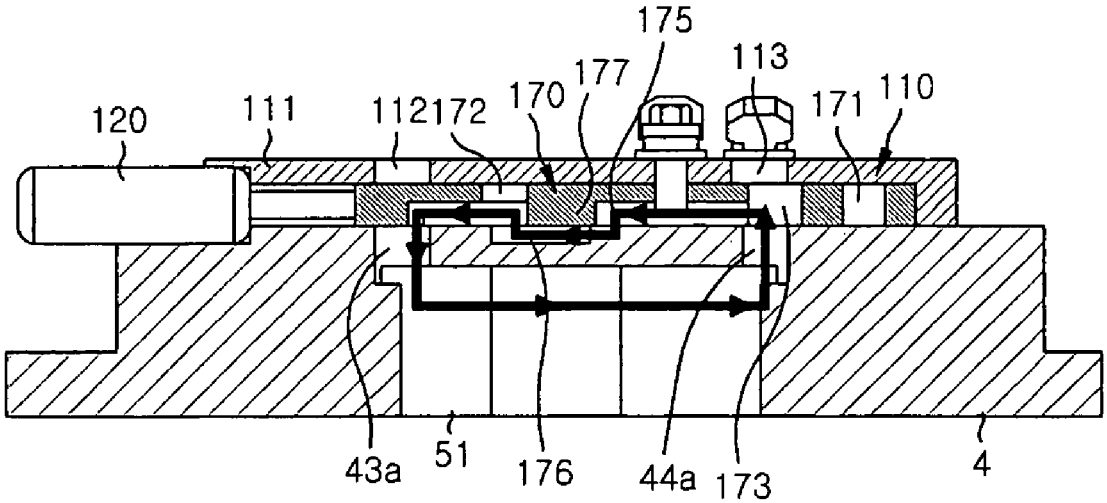

FIGS. 9A to 9C illustrate a capacity-changing unit of an orbiting vane compressor according to a fifth preferred embodiment of the present invention.

FIG. 9A is a perspective view illustrating an actuator 170. The actuator 170 has a discharge side opening/closing hole 171 formed at one longitudinal side of the actuator 170. The discharge side opening/closing hole 171 vertically extends through the actuator 170. Also, the actuator 170 has a suction side opening/closing hole 172 formed at the other longitudinal side of the actuator 170. Between the suction side opening/closing hole 172 and the discharge side opening/closing hole 171 is disposed a communication hole 173.

At the actuator 170, under the suction side opening/closing hole 172, is formed a first communication groove 174, which communicates with the suction side opening/closing hole 172. Opposite ends of the first communication groove 174 are closed. At the actuator 170, under the communication hole 173, is formed a second communication groove 175, which communicates with the communication hole 173. Opposite ends of the second communication groove 175 are also closed. Between the first communication groove 174 and the second communication groove 175 is disposed a suction guide 177. Correspondingly, the cylinder 4 has an upper open groove 176, which is disposed between the outer inlet port 43*a* of the cylinder 4 and the outer outlet port 44*a* of the cylinder 4. The upper open groove 176 of the cylinder 4 is opposite to the first communication groove 174 and the second communication groove 175.

When the actuator 170 is moved rearward by the solenoid 120, as shown in FIG. 9B, the valve inlet port 112 communicates with the outer inlet port 43*a* of the cylinder 4 through the suction side opening/closing hole 172 and the first communication groove 174, and the valve outlet port 113 communicates with the outer outlet port 44*a* of the cylinder 4 through the discharge side opening/closing hole 171.

At this time, the suction guide 177 of the actuator 170 serves to prevent low-temperature refrigerant gas introduced through the suction side opening/closing hole 172 from flowing to the outer outlet port 44*a* of the cylinder 4, through which compressed high-temperature refrigerant gas is discharged. The second communication groove 175, which is disposed between the suction side opening/closing hole 172 and the discharge side opening/closing hole 171, does not communicate with the outer inlet port 43*a* of the cylinder 4 as well as the outer outlet port 44*a* of the cylinder 4.

Consequently, refrigerant gas is introduced into the cylinder 5 through the valve inlet port 112, the suction side opening/closing hole 172 and the first communication groove 174 of the actuator 170, and the outer inlet port 43*a* of the cylinder 4, and is then compressed in the cylinder 4. The compressed refrigerant gas is discharged out of the cylinder 4 through the outer outlet port 44*a* of the cylinder 4, the discharge side opening/closing hole 171 of the actuator 170, and the valve outlet port 113. In this way, compression in the outer compression chamber of the cylinder is accomplished.

When the actuator 170 is moved forward by the solenoid 120, as shown in FIG. 9C, on the other hand, the suction side opening/closing hole 172 of the actuator 170 is not aligned with the valve inlet port 112 and the outer inlet port 43*a* of the cylinder 4. As a result, the valve inlet port 112 does not communicate with the outer inlet port 43*a* of the cylinder 4. However, the first communication groove 174 still communicates with the outer inlet port 43*a* of the cylinder 4.

Also, the discharge side opening/closing hole 171 of the actuator 170 is not aligned with the valve outlet port 113 and the outer outlet port 44*a* of the cylinder 4. However, the communication hole 173 and the second communication groove 175 communicate with the valve outlet port 113 and the outer outlet port 44*a* of the cylinder 4. Also, the suction guide 177, which is disposed between the first communication groove 174 and the second communication groove 175, is placed in the middle of the upper open groove 176 of the cylinder 4. As a result, the first communication groove 174 communicates with the second communication groove 175.

Consequently, the refrigerant gas introduced into the cylinder 4 is compressed by an orbiting movement of the circular vane 51 while further introduction of refrigerant gas is interrupted. The compressed refrigerant gas is discharged out of the cylinder 4 through the outer outlet port 44*a* of the cylinder 4, the communication hole 173 of the actuator 170, and the valve outlet port 113. At this time, some of the compressed refrigerant gas is introduced into the outer inlet port 43*a* of the cylinder 4 through the second communication groove 175 of the actuator 170, the upper open groove 176 of the cylinder 4, and the first communication groove 174 of the actuator 170. Consequently, the outer inlet port 43*a* of the cylinder 4 communicates with the outer outlet port 44*a* of the cylinder 4.

The illustrated smart control valve 110 is a valve wherein the first actuating part (not shown) and the second actuating part 110*b* are actuated in the same direction. In this case, the orbiting vane compressor is operated in three-stage mode. Specifically, compression is performed in both the inner and outer compression chambers or compression is performed only in either the inner compression chamber or the outer compression chamber.

Figure 10A:
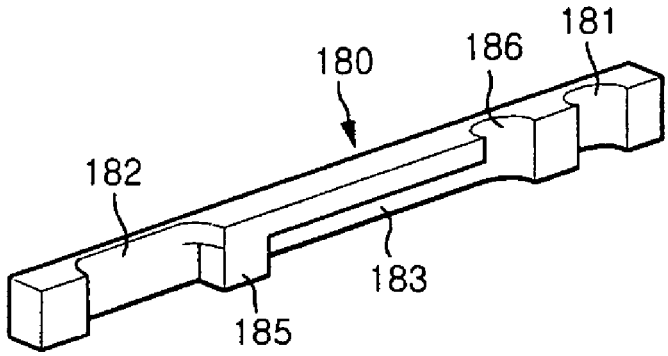
Figure 10B:
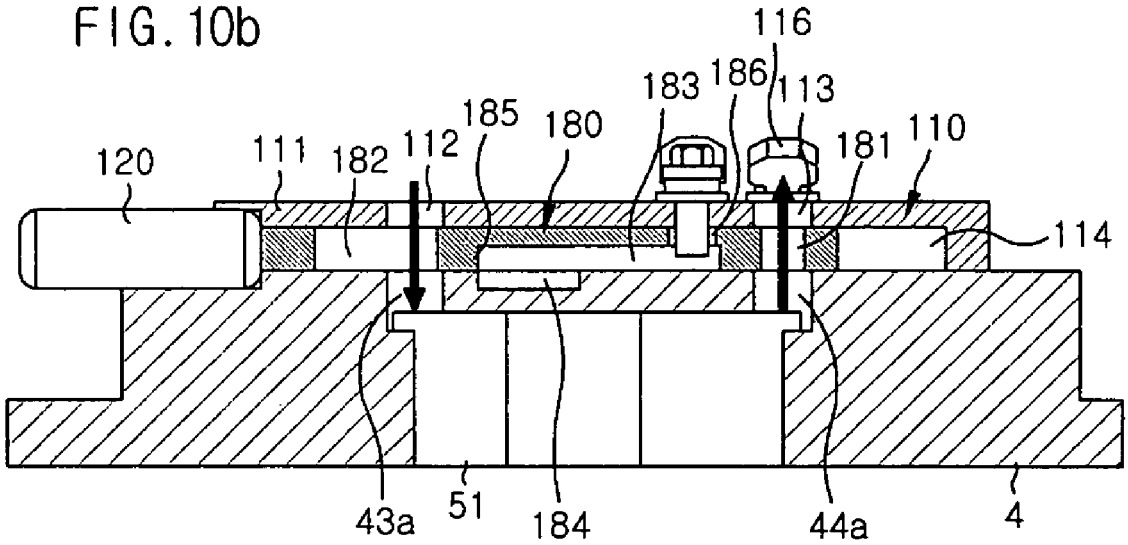
Figure 10C:
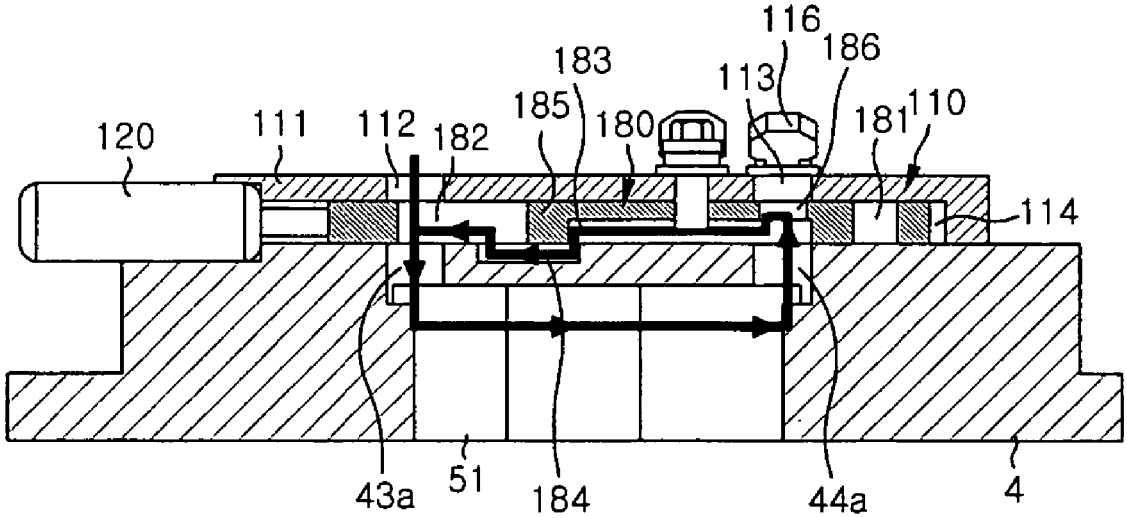

FIGS. 10A to 10C illustrate a capacity-changing unit of an orbiting vane compressor according to a sixth preferred embodiment of the present invention.

FIG. 10A is a perspective view illustrating an actuator 180. As shown in FIG. 10A, the actuator 180 has first and second discharge side opening/closing holes 181 and 186 formed at one longitudinal side of the actuator 180. The first and second discharge side opening/closing holes 181 and 186 vertically extend through the actuator 180. Also, the actuator 180 has an elongated suction hole 182 formed at the other longitudinal side of the actuator 180. The elongated suction hole 182 has an elliptical section. At the lower part of the actuator 180, between the elongated suction hole 182 and the first discharge side opening/closing hole 181, is formed a communication groove 183, opposite ends of which are closed. The communication groove 183 is constructed such that the communication groove 183 communicates with the second discharge side opening/closing hole 186, but the communication groove 183 does not communicate with the elongated suction hole 182 and discharge side opening/closing hole 181. Between the elongated suction hole 182 and the communication groove 183 is disposed a suction guide 185. Correspondingly, the cylinder 4 has an upper open groove 184, which is disposed between the outer inlet port 43*a* of the cylinder 4 and the outer outlet port 44*a* of the cylinder 4. The upper open groove 184 of the cylinder 4 is opposite to the communication groove 183 of the actuator 180.

When the actuator 180 is moved rearward by the solenoid 120, as shown in FIG. 10B, the first discharge side opening/closing hole 181 is aligned with the outer outlet port 44*a* of the cylinder 4 and the valve outlet port 113. As a result, the outer outlet port 44*a* of the cylinder 4 communicates with the valve outlet port 113 through the first discharge side opening/closing hole 181. Also, the outer inlet port 43*a* of the cylinder 4 communicates with the valve inlet port 112 through the elongated suction hole 182. At this time, the communication groove 183, which is disposed between the elongated suction hole 182 and the first discharge side opening/closing hole 181, does not communicate with the outer inlet port 43*a* of the cylinder 4 as well as the outer outlet port 44*a* of the cylinder 4.

Consequently, refrigerant gas is introduced into the cylinder 4 through the valve inlet port 112, the elongated suction hole 182, and the outer inlet port 43*a* of the cylinder 4. The refrigerant gas introduced into the cylinder 4 is compressed in the outer compression chamber of the cylinder 4, and is then discharged out of the cylinder 4 through the outer outlet port 44*a* of the cylinder 4, the first discharge side opening/closing hole 181 of the actuator 180, and the valve outlet port 113. In this way, compression in the outer compression chamber of the cylinder is accomplished.

When the actuator 180 is moved forward by the solenoid 120, as shown in FIG. 10C, on the other hand, the first discharge side opening/closing hole 181 of the actuator 180 is not aligned with the outer outlet port 44*a* of the cylinder 4 and the valve outlet port 113. At this time, the second discharge side opening/closing hole 186 and the communication groove 183 of the actuator 180 communicate with the outer outlet port 44*a* of the cylinder 4 and the valve outlet port 113. However, the suction pressure of the refrigerant gas introduced through the elongated suction hole 182 of the actuator 180 is applied to a discharge reed valve 116. As a result, the discharge reed valve 116 is operated by the difference between the suction pressure applied to the discharge reed valve 116 and the discharge pressure from the discharge reed valve 116, and therefore, the valve outlet port 113 is closed. At this time, the outer inlet port 43*a* of the cylinder 4 still communicates with the valve inlet port 112 through the elongated suction hole 182 of the actuator 180.

Also, the suction guide 185 of the actuator 180 is placed in the upper open groove 184 of the cylinder 4. As a result, the communication groove 183 communicates with the elongated suction hole 182 through the upper open groove 184 of the cylinder 4. Consequently, the refrigerant gas discharged through the outer outlet port 44*a* of the cylinder 4 is introduced into the second discharge side opening/closing hole 186 and the communication groove 183 of the actuator 180, and is then introduced into the elongated suction hole 182 through the upper open groove 184 of the cylinder 4. In this way, the outer inlet port 43*a* of the cylinder 4 communicates with the outer outlet port 44*a* of the cylinder 4.

When the compression is performed as shown in FIG. 10B, the suction guide 185 serves to prevent low-temperature refrigerant gas introduced through the elongated suction hole 182 of the actuator 180 from flowing to the outer outlet port 44*a* of the cylinder 4, through which compressed high-temperature refrigerant gas is discharged. Consequently, undesired preheating of the low-temperature refrigerant gas is effectively prevented by the provision of the suction guide 185.

The illustrated smart control valve 110 is a valve wherein the first actuating part (not shown) and the second actuating part 110*b* are actuated in the same direction. In this case, the orbiting vane compressor is operated in three-stage mode. Specifically, compression is performed in both the inner and outer compression chambers or compression is performed only in either the inner compression chamber or the outer compression chamber.

The capacity-changing unit of the orbiting vane compressor according to the sixth preferred embodiment of the present invention is characterized in that the suction pressure is applied to the discharge reed valve 116 through the second discharge side opening/closing hole when no-load operation of the orbiting vane compressor is performed, and therefore, operability of the valve is improved, and in that the discharge reed valve 116 is operated by the difference between the suction pressure applied to the discharge reed valve 116 and the discharge pressure from the discharge reed valve 116, and therefore, the sealing of the discharge reed valve 116 is improved.

As apparent from the above description, the present invention provides a capacity-changing unit of an orbiting vane compressor having inner and outer compression chambers formed at the inside and the outside of a circular vane as the circular vane performs an orbiting movement in a cylinder that is capable of selectively accomplishing compression or communication in the inner and outer compression chambers of the cylinder through simple manipulation of a valve, thereby easily changing the capacity of the orbiting vane compressor. Consequently, the present invention has the effect of accomplishing economical efficiency of the orbiting vane compressor, reducing power consumption due to repetitive on/off operation of the orbiting vane compressor, preventing reduction in service life of the orbiting vane compressor due to premature wear of the parts of the orbiting vane compressor, and therefore, improving the performance and reliability of the orbiting vane compressor.

Furthermore, compression and communication are performed in either the inner compression chamber or the outer compression chamber of the cylinder through the manipulation of the valve. Consequently, the present invention has the effect of accomplishing operation of the orbiting vane compressor in two-stage mode in which compression is performed in either the inner compression chamber or the outer compression chamber of the cylinder.

Moreover, selective compression and communication are performed in the inner and outer compression chambers of the cylinder, or simultaneous compression and communication are performed in the inner and outer compression chambers of the cylinder, through the manipulation of the valve. Consequently, the present invention has the effect of accomplishing operation of the orbiting vane compressor in three-stage mode in which the compression are performed in both the inner and outer compression chambers of the cylinder or the compression are performed in either the inner compression chamber or the outer compression chamber of the cylinder. Furthermore, design freedom of the orbiting vane compressor is accomplished based on combination of the two-stage and three-stage modes according to the present invention.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A capacity changer of an orbiting vane compressor, comprising:

inner and outer compression chambers provided in a cylinder, the inner and outer compression chambers being separated from each other by a circular vane of an orbiting vane positioned within an annular space of the cylinder;

inner and outer inlet ports provided at an upper part of the cylinder, the inner inlet port communicating with the inner compression chamber and the outer inlet port communicating with the outer compression chamber;

inner and outer outlet ports provided at the upper part of the cylinder, the inner outlet port communicating with the inner compression chamber and the outer outlet port communicating with the outer compression chamber; and a control valve comprising:

a valve body provided on the cylinder;

a first actuator provided at a first side of the valve body, the first actuator being in communication with and compressing a fluid within the inner compression chamber of the cylinder, the first actuator being configured to reciprocate linearly as a second actuator provided at a second side of the valve body is actuated; and the second actuator being in communication with and compressing a fluid within the outer compression chamber of the cylinder, the second actuator being configured to reciprocate linearly as the first actuator is actuated.

2. The capacity changer as set forth in claim 1, wherein the control valve is configured to actuate the first and second actuators symmetrically to each other.

3. The capacity changer as set forth in claim 2, wherein the valve body has valve inlet and outlet ports provided at corresponding sides of the valve body, the valve inlet port communicating with the inner and outer inlet ports of the cylinder and the valve outlet port communicating with the inner and outer outlet ports of the cylinder.

4. The capacity changer as set forth in claim 3, further comprising:

an actuating groove positioned beneath the valve inlet port and the valve outlet port, the actuating groove including a side having a side opening; and a solenoid provided at the side opening of the actuating groove, the solenoid being configured to actuate a valve actuator.

5. The capacity changer as set forth in claim 4, wherein the valve actuator comprises:

a discharge side opening/closing hole provided proximate a first longitudinal side of the valve actuator, the discharge side opening/closing hole being configured to provide selective communication between the valve outlet port and the inner and outer outlet ports of the cylinder; and a communication groove provided proximate a second longitudinal side of the valve actuator, the communication groove having an open side.

6. The capacity changer as set forth in claim 4, wherein the valve actuator comprises:

a discharge side opening/closing hole provided proximate a first longitudinal side of the valve actuator, the discharge side opening/closing hole being configured to provide selective communication between the valve outlet port and the inner and outer outlet ports of the cylinder;

an elongated suction hole provided proximate a second longitudinal side of the valve actuator and configured to maintain communication between the valve inlet port and the inner and outer inlet ports of the cylinder; and a communication groove provided beneath the elongated suction hole, the communication groove extending toward the discharge side opening/closing hole, wherein opposing ends of the communication groove are closed.

7. The capacity changer as set forth in claim 4, wherein the valve actuator comprises:

a communication groove provided at a lower side of the valve actuator, the opposing ends of the communication groove being closed;

a suction side opening/closing hole provided above the communication groove and adjacent to a first side of the communication groove, the suction side opening/closing hole communicating with the communication groove;

a communication hole provided above the communication groove and adjacent to a second side of the communication groove, the communication hole communicating with the communication groove; and a discharge side opening/closing hole provided adjacent to the communication hole, the discharge side opening/closing hole being configured to provide selective communication between the valve outlet port and the inner and outer outlet ports of the cylinder.

8. The capacity changer as set forth in claim 4, wherein the valve actuator comprises:

a discharge side opening/closing hole provided at a first longitudinal side, the discharge side opening/closing hole being configured to provide selective communication between the valve outlet port and the inner and outer outlet ports of the cylinder;

an elongated suction hole provided proximate a second longitudinal side of the valve actuator and configured to maintain communication between the valve inlet port and the inner and outer inlet ports of the cylinder;

a communication groove provided at a lower portion of the valve actuator between the elongated suction hole and the discharge side opening/closing hole, the opposing ends of the communication groove being closed; and a suction guide positioned between the elongated suction hole and the communication groove, and wherein the cylinder comprises an upper open groove positioned between the inner and outer inlet ports of the cylinder and the inner and outer outlet ports of the cylinder, the upper open groove opposing the communication groove of the valve actuator.

9. The capacity changer as set forth in claim 4, wherein the valve actuator comprises:

a discharge side opening/closing hole provided at a first longitudinal side of the valve actuator, the discharge side opening/closing hole being configured to provide selective communication between the valve outlet port and the inner and outer outlet ports of the cylinder;

a suction side opening/closing hole provided at a second longitudinal side, the discharge side opening/closing hole being configured to provide selective communication between the valve inlet port and the inner and outer inlet ports of the cylinder;

a communication hole positioned between the suction side opening/closing hole and the discharge side opening/closing hole;

a first communication groove provided beneath the suction side opening/closing hole, the first communication groove communicating with the suction side opening/closing hole and opposing ends of the first communication groove being closed;

a second communication groove positioned beneath the communication hole, the second communication groove communicating with the communication hole, opposing ends of the second communication groove being closed; and a suction guide positioned between the first communication groove and the second communication groove, wherein the cylinder includes an upper open groove positioned between the inner and outer inlet ports of the cylinder and the inner and outer outlet ports of the cylinder, the upper open groove opposing the second communication groove of the valve actuator.

10. The capacity changer as set forth in claim 4, wherein the valve actuator comprises:

first and second discharge side opening/closing holes provided at a first longitudinal side of the valve actuator, the discharge side opening/closing hole being configured to provide selective communication between the valve outlet port and the inner and outer outlet ports of the cylinder;

an elongated suction hole provided at the first longitudinal side of the valve actuator and configured to maintain communication between the valve inlet port and the inner and outer inlet ports of the;

a communication groove provided at a lower portion of the valve actuator between the elongated suction hole and the discharge side opening/closing hole, the communication groove communicating with the second discharge side opening/closing hole and opposing ends of the communication groove being closed; and a suction guide positioned between the elongated suction hole and the communication groove, and wherein the cylinder includes an upper open groove positioned between the inner and outer inlet ports of the cylinder and the inner and outer outlet ports of the cylinder, the upper open groove opposing the second communication groove of the valve actuator.

11. The capacity changer as set forth in claim 1, wherein the control valve is configured to actuate the first and second actuators symmetrically to each other.

12. The capacity changer as set forth in claim 11, wherein the valve body has valve inlet and outlet ports provided at corresponding sides of the valve body, the valve inlet port communicating with the inner and outer inlet ports of the cylinder and the valve outlet port communicating with the inner and outer outlet ports of the cylinder.

13. The capacity changer as set forth in claim 12, further comprising:

an actuating groove positioned beneath the valve inlet port and the valve outlet port, the actuating groove including a side having a side opening; and a solenoid provided at the side opening of the actuating groove, the solenoid being configured to actuate a valve actuator.

14. The capacity changer as set forth in claim 13, wherein the valve actuator comprises:

a discharge side opening/closing hole provided proximate a first longitudinal side of the valve actuator, the discharge side opening/closing hole being configured to provide selective communication between the valve outlet port and the inner and outer outlet ports of the cylinder; and a communication groove provided proximate a second longitudinal side of the valve actuator, the communication groove having an open side.

15. The capacity changer as set forth in claim 13, wherein the valve actuator comprises:

a discharge side opening/closing hole provided proximate a first longitudinal side of the valve actuator, the discharge side opening/closing hole being configured to provide selective communication between the valve outlet port and the inner and outer outlet ports of the cylinder;

an elongated suction hole provided proximate a second longitudinal side of the valve actuator and configured to maintain communication between the valve inlet port and the inner and outer inlet ports of the cylinder; and a communication groove provided beneath the elongated suction hole, the communication groove extending toward the discharge side opening/closing hole, wherein opposing ends of the communication groove are closed.

16. The capacity changer as set forth in claim 13, wherein the valve actuator comprises:

a communication groove provided at a lower side of the valve actuator, the opposing ends of the communication groove being closed;

a suction side opening/closing hole provided above the communication groove and adjacent to a first side of the communication groove, the suction side opening/closing hole communicating with the communication groove;

a communication hole provided above the communication groove and adjacent to a second side of the communication groove, the communication hole communicating with the communication groove; and a discharge side opening/closing hole provided adjacent to the communication hole, the discharge side opening/closing hole being configured to provide selective communication between the valve outlet port and the inner and outer outlet ports of the cylinder.

17. The capacity changer as set forth in claim 13, wherein the valve actuator comprises:

a discharge side opening/closing hole provided at a first longitudinal side, the discharge side opening/closing hole being configured to provide selective communication between the valve outlet port and the inner and outer outlet ports of the cylinder;

an elongated suction hole provided proximate a second longitudinal side of the valve actuator and configured to maintain communication between the valve inlet port and the inner and outer inlet ports of the cylinder;

a communication groove provided at a lower portion of the valve actuator between the elongated suction hole and the discharge side opening/closing hole, the opposing ends of the communication groove being closed; and a suction guide positioned between the elongated suction hole and the communication groove, and wherein the cylinder comprises an upper open groove positioned between the inner and outer inlet ports of the cylinder and the inner and outer outlet ports of the cylinder, the upper open groove opposing the communication groove of the valve actuator.

18. The capacity changer as set forth in claim 13, wherein the valve actuator comprises:

a discharge side opening/closing hole provided at a first longitudinal side of the valve actuator, the discharge side opening/closing hole being configured to provide selective communication between the valve outlet port and the inner and outer outlet ports of the cylinder;

a suction side opening/closing hole provided at a second longitudinal side of the valve actuator, the discharge side opening/closing hole being configured to provide selective communication between the valve inlet port and the inner and outer inlet ports of the cylinder;

a communication hole positioned between the suction side opening/closing hole and the discharge side opening/closing hole;

a first communication groove provided beneath the suction side opening/closing hole, the first communication groove communicating with the suction side opening/closing hole and opposing ends of the first communication groove being closed;

a second communication groove positioned beneath the communication hole, the second communication groove communicating with the communication hole, opposing ends of the second communication groove being closed; and a suction guide positioned between the first communication groove and the second communication groove, and wherein the cylinder includes an upper open groove positioned between the inner and outer inlet ports of the cylinder and the inner and outer outlet ports of the cylinder, the upper open groove opposing the second communication groove of the valve actuator.

19. The capacity changer as set forth in claim 13, wherein the valve actuator comprises:

first and second discharge side opening/closing holes provided at a first longitudinal side of the valve actuator, the discharge side opening/closing hole being configured to provide selective communication between the valve outlet port and the inner and outer outlet ports of the cylinder;

an elongated suction hole provided at the first longitudinal side of the valve actuator and configured to maintain communication between the valve inlet port and the inner and outer inlet ports of the cylinder;

a communication groove provided at a lower portion of the valve actuator between the elongated suction hole and the discharge side opening/closing hole, the communication groove communicating with the second discharge side opening/closing hole, opposing ends of the communication groove being closed; and a suction guide positioned between the elongated suction hole and the communication groove, and wherein the cylinder includes an upper open groove positioned between the inner and outer inlet ports of the cylinder and the inner and outer outlet ports of the cylinder, the upper open groove opposing the second communication groove of the valve actuator.

* * * * *